US005358134A

United States Patent [19]

Ripley et al.

[11] Patent Number: 5,358,134

[45] Date of Patent: Oct. 25, 1994

[54] DISPLAY PACKAGE

[75] Inventors: Richard E. Ripley, Attleboro, Mass.; Marc Solda, Bethlehem, Pa.

[73] Assignee: Textron Inc., Providence, R.I.

[21] Appl. No.: 120,587

[22] Filed: Sep. 13, 1993

[51] Int. Cl.[5] ..... B65D 41/18; B65D 85/40

[52] U.S. Cl. ..... 220/307; 206/45.34; 206/301; 220/4.21; 220/324; 220/340

[58] Field of Search ..... 206/301, 45.19, 45.31, 206/45.34, 470; 220/337, 338, 307, 306, 4.21, 324, 326, 340

[56] References Cited

U.S. PATENT DOCUMENTS

| | | | |
|---|---|---|---|
| 2,120,826 | 6/1938 | Young | 206/45.34 |
| 2,441,857 | 5/1948 | Waterman | 220/4.21 |
| 2,563,157 | 8/1951 | Castelli | 206/45.34 |
| 2,576,708 | 11/1951 | Williamson | 206/45.34 |
| 2,733,830 | 2/1956 | Ruskin | 220/338 |
| 3,171,565 | 3/1965 | Nozette | 220/306 X |
| 3,182,790 | 5/1965 | Bieganousky et al. | 206/45.34 X |
| 3,344,913 | 10/1967 | Best | 220/324 X |
| 3,365,056 | 1/1968 | Mandel | 206/301 X |
| 3,371,772 | 3/1968 | Fontannaz | 206/45.19 X |
| 3,394,835 | 7/1968 | Peterson | 220/337 |
| 3,465,090 | 9/1969 | Rose | 220/306 X |
| 3,563,370 | 2/1971 | Nozette et al. | 206/45.34 X |
| 3,842,974 | 10/1974 | Jacobsen | 206/45.34 |
| 3,918,577 | 11/1975 | Horzick | 206/45.34 |
| 4,016,972 | 4/1977 | Szamborski | 206/45.34 |
| 5,154,292 | 10/1992 | Bartucca et al. | 220/4.21 X |

*Primary Examiner*—Bryon P. Gehman

*Attorney, Agent, or Firm*—Samuels, Gauthier & Stevens

[57] ABSTRACT

The present invention provides a novel and unique display package. The package includes separable tray and cover components each having parallel side walls joined by end walls. In the assembled state, the side walls of the cover and tray are arranged in a mutually abutting coplanar relationship, with the end walls of the cover being tightly contained between and immobilized with respect to the end walls of the tray. Thus, the side walls of the cover do not intrude into the tray to limit its available width, nor is the cover prone to rattling.

5 Claims, 4 Drawing Sheets

DISPLAY PACKAGE

BACKGROUND OF THE INVENTION

1. Field of the Invention

This invention relates generally to the packaging art, and is concerned in particular with an improved display package for watchbands and other like articles of manufacture.

2. Description of the Prior Art

A conventional widely employed watchband display package includes separable transparent tray and cover components. The cover has side walls which are loosely received in a telescoped relationship within the side walls of the tray in the assembled state. Interlocking elements integrally associated with the telescoped side walls serve to releasably interconnect the assembled tray and cover.

Several disadvantages are associated with this type of packaging. First, the telescoped side walls of the cover intrude into the tray and in so doing, limit the space available for accommodating watchbands of increased width.

Second, the interlocking elements of the telescoped side walls are confusingly intricate and difficult to manipulate, so much so that the cover and tray components are often broken as a result of being pulled apart by frustrated consumers.

Third, the interlocking elements provide a somewhat loose connection between the tray and cover, which can result in relative movement and rattling between the two during subsequent handling.

SUMMARY OF THE INVENTION

The present invention provides a novel and unique display package which overcomes the above described disadvantages. In particular, the present package includes separable tray and cover components each having parallel side walls joined by end walls. In the assembled state, the side walls of the cover and tray are arranged in a mutually abutting coplanar relationship, with the end walls of the cover being tightly contained between and immobilized with respect to the end walls of the tray. Thus, the side walls of the cover do not intrude into the tray to limit its available width, nor is the cover prone to rattling.

The cover and tray are releasably interconnected by interlocking elements associated with their respective end walls, with straightforward simplified manipulation at only one end of the package being required in order to open and separate the cover from the tray.

These and other objectives and advantages of the present invention will become more apparent as the description proceeds with the aid of the accompanying drawings, wherein:

DETAILED DESCRIPTION OF PREFERRED EMBODIMENT

Figure 1:
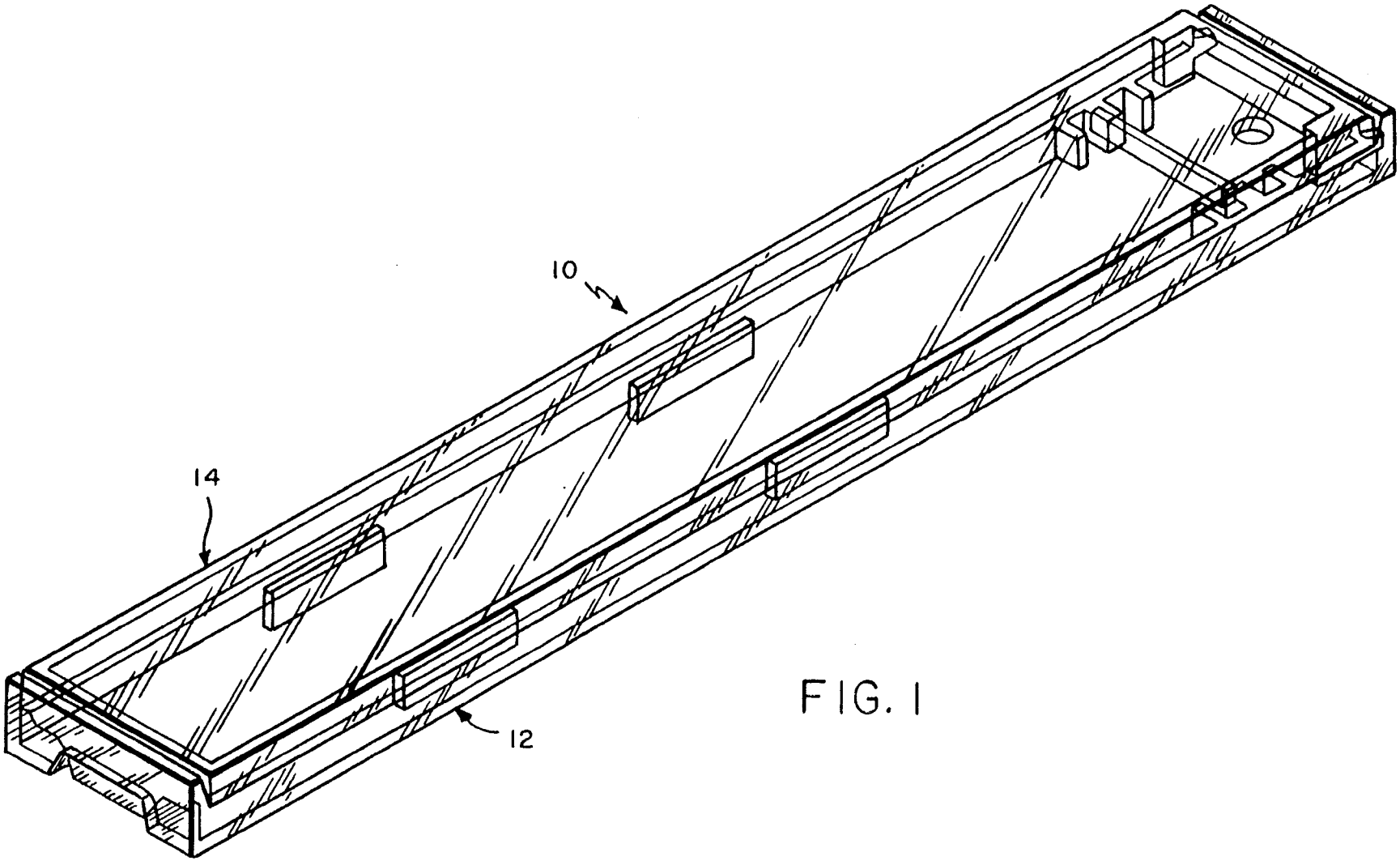
FIG. 1 is a perspective view of a display package in accordance with the present invention.
Figure 2:
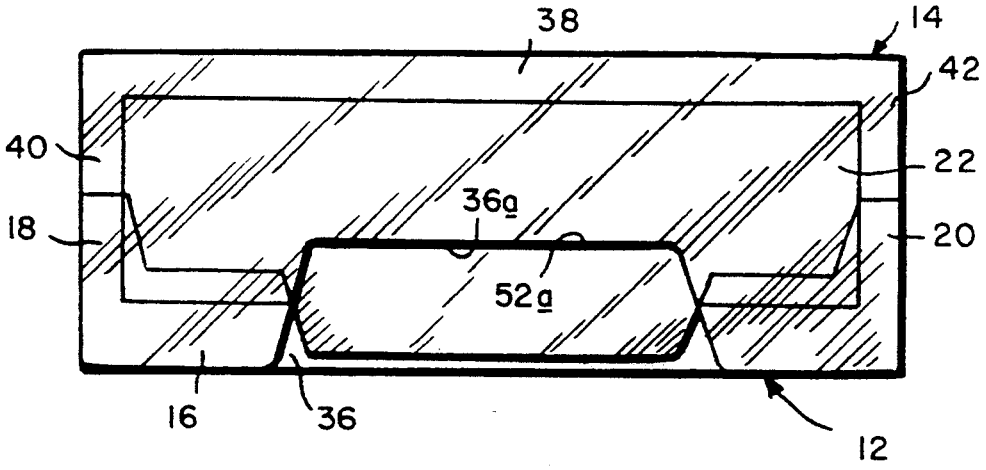
FIG. 2 is a front end view of the package.
Figure 3:
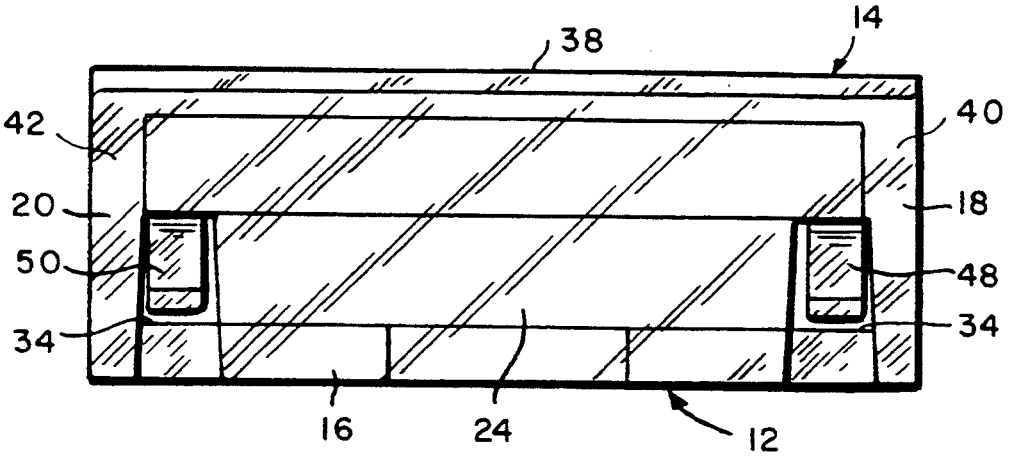
FIG. 3 is a rear end view of the package.
Figure 7:
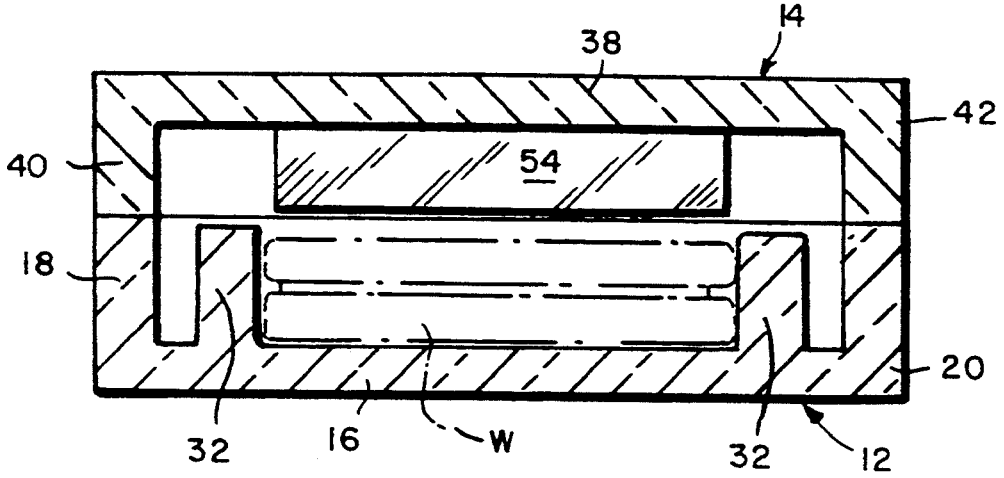
FIG. 5, 6 and 7 are sectional views on an enlarged scale taken respectively along lines 5—5, 6—6 and 7—7 of FIG. 4.
Figure 4:
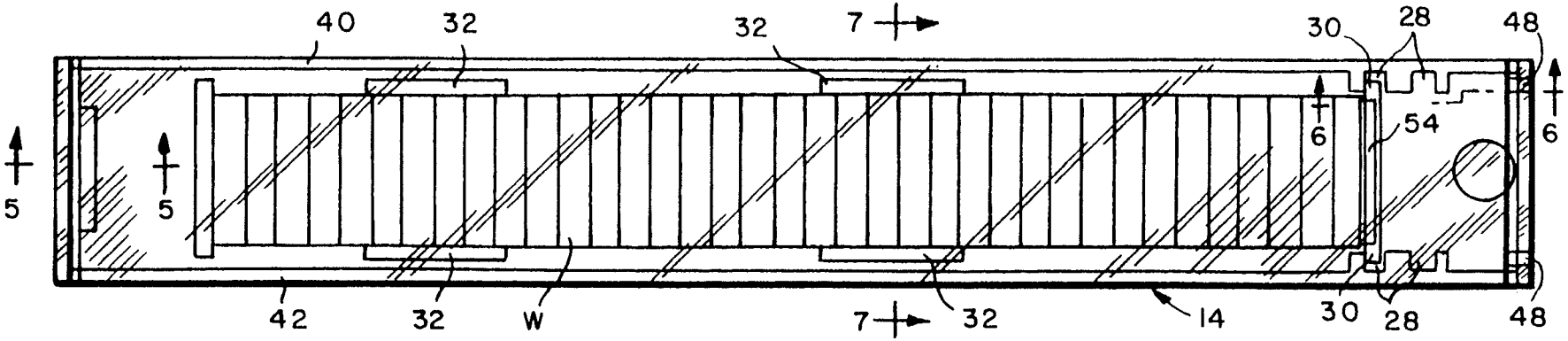
FIG. 4 is a top plan view of the package showing a watchband contained therein.
Figure 6:
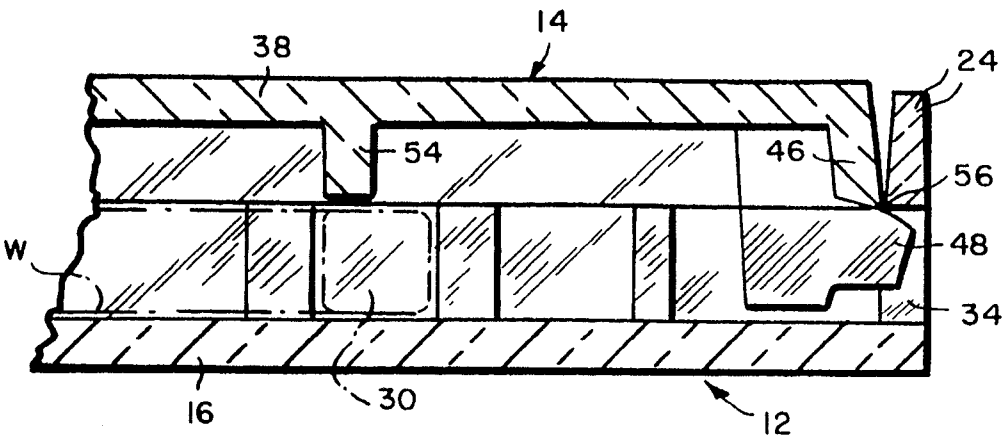
Figure 5:
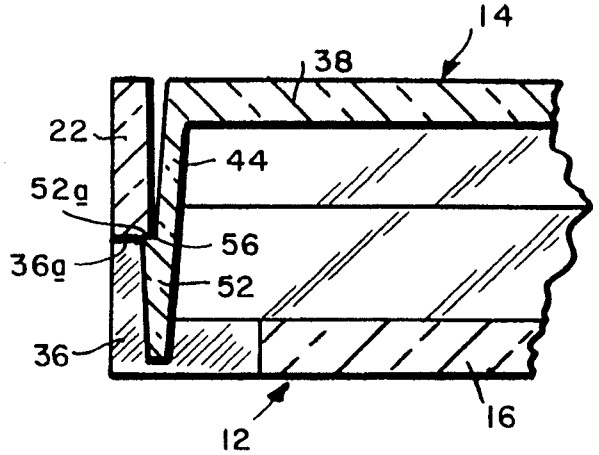

Referring now to the drawings, a display package in accordance with the present invention is shown at 10. The display package includes separable releasably interconnected tray and cover components 12, 14. At least one and preferably both of the tray and cover components are transparent, and conveniently manufactured as injection molded plastic pieces.

The tray 12 includes a bottom wall 16, parallel side walls 18, 20 and transverse end walls 22, 24 arranged to define an open compartment for receiving a watchband 26 or other like article of manufacture. The side walls 18, 20 are provided at one end with inwardly protruding oppositely disposed integral protrusions defining opposed notches 28 for receiving the laterally protruding adjustable spring bar retainers 30 at one end of the watchband "W". Guide members 32 extend upwardly from the bottom wall 16 to laterally confine the watchband within the tray.

End wall 24 has laterally spaced openings 34 extending therethrough, and end wall 22 is likewise provided with a single centrally disposed opening 36 bordered by an upper edge 36*a*.

Cover 14 includes a top wall 38, parallel side walls 40, 42 and transverse end walls 44, 46. A pair of ears 48, 50 protrude rearwardly beyond the end wall 46. End wall 44 is configured to define a latch member 52 having a stepped outer face defining a shoulder 52*a*. A retaining rib 54 protrudes downwardly from the top wall 38 and extends laterally between the side walls 40, 42.

Figure 8:
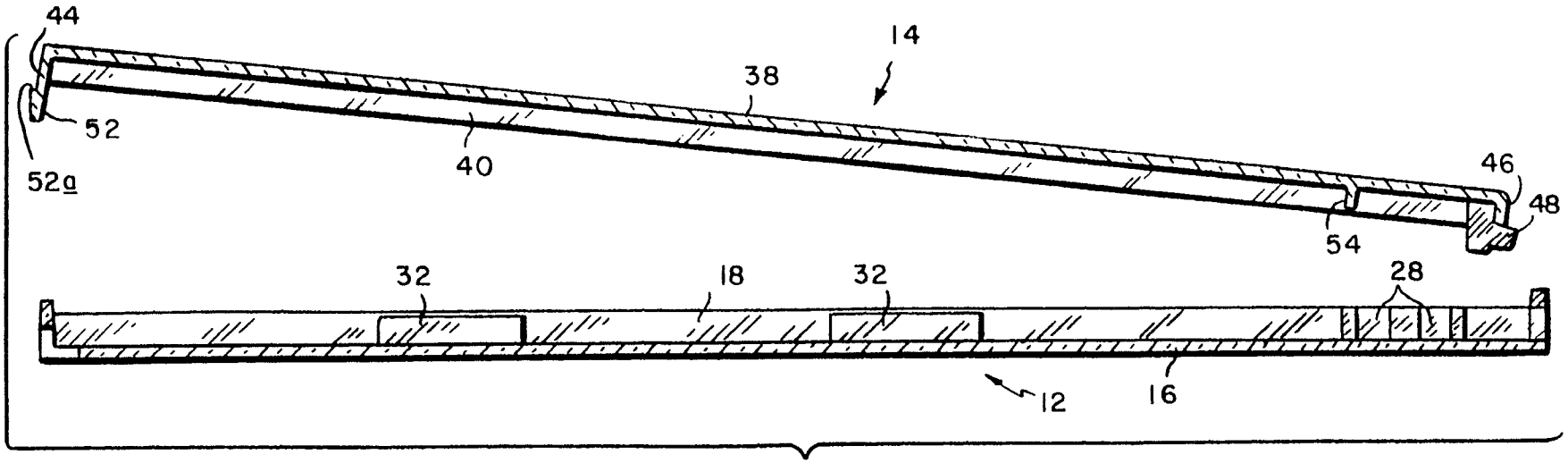
FIG. 8 is an explored longitudinal sectional view of the cover and tray in the disassembled state.

During assembly, the cover 14 is first disposed angularly with respect to the tray 12, as shown in FIG. 8, and the rearwardly protruding ears 48, 50 are then inserted into the openings 34 in end wall 24. The cover and tray are then pivotally closed, bringing the cover side walls 40, 42 into coplanar abutting relationship respectively with the tray side walls 18, 20 as the cover end wall 44 deflects resiliently inwardly and slides inside the tray end wall 22. This causes the latch member 52 to align itself with the opening 36 as the shoulder 52*a* snaps beneath the upper edge 36*a*. This snap interlock releasably retains the tray and cover in the assembled state, with their respective side walls in coplanar mutual contact, and with the end walls 44, 46 of the cover tightly confined as at 56 between the end walls 22, 24 of the tray. The retaining rib 54 on the cover serves to hold the watchband down against the bottom wall 16 of the tray, thereby insuring that the spring bar retainers 30 remain seated in the selected notches 28.

It will thus be seen that with this arrangement, the side walls 40, 42 of the cover do not intrude into the tray to unnecessarily limit the lateral space available for accommodating wider watchband designs. The cover is tightly held between the end walls of the tray, thereby providing a solid rattle free assembly. The single latch member 52 is conveniently and easily depressed to allow pivotal opening and removal of the cover.

We claim:

1. A display package comprising in combination:

a tray defined by a bottom wall, first side walls and first end walls, said first side walls having upper edges, said first end walls having lower portions extending between said first side walls and having upper portions protruding above said upper edges;

a cover defined by a top wall, second side walls and second end walls, said second end walls having lower edges, said second end walls having upper portions extending between said second side walls and having lower portions protruding below said lower edges;

said tray and cover being configured and dimensioned for assembly with said top wall overlying said bottom wall, with the upper edges of said first side walls abutting the lower edges of said second side walls, and with said second end walls tightly confined between said first end walls; and engagement means associated with the lower portions of said first and second end walls for releasably interconnecting the thus assembled tray and cover.

2. The display package of claim 1 wherein at least one of said tray and cover are transparent.

3. The display package of claim 1 wherein said tray and cover are transparent.

4. The display package of claim 1 wherein said engagement means includes ears protruding from one end of said cover into apertures in a first end wall at one of said tray to thereby establish a pivotal relationship between said components.

5. The display package of claim 4 wherein said engagement means further includes a resilient tab integrally formed on a second end wall at the opposite end of said cover, said tab being configured and dimensioned to be received in releasable interlocked engagement within an opening in a first end wall at the opposite end of said tray.

* * * * *